United States Patent [19]

Addison

[11] Patent Number: 4,533,317

[45] Date of Patent: Aug. 6, 1985

[54] YTTRIUM OXIDE MANTLES FOR FUEL-BURNING LANTERNS

[75] Inventor: Gilbert J. Addison, Wichita, Kans.

[73] Assignee: The Coleman Company, Inc., Wichita, Kans.

[21] Appl. No.: 527,217

[22] Filed: Aug. 29, 1983

[51] Int. Cl.[3] ..... F21H 3/00; F21H 1/02

[52] U.S. Cl. ..... 431/100; 126/97; 427/159; 252/492

[58] Field of Search ..... 431/100, 325; 126/45, 126/96, 92 R, 92 AC, 97, 44, 195; 427/159; 252/492

[56] References Cited

U.S. PATENT DOCUMENTS

| | | | |
|---|---|---|---|
| 269,204 | 8/1889 | Welsbach | 431/100 X |
| 359,524 | 3/1897 | Welsbach . | |
| 399,174 | 3/1889 | Welsbach . | |
| 463,470 | 11/1891 | Welsbach | 427/159 |
| 563,524 | 7/1896 | Welsbach . | |
| 574,862 | 1/1897 | Deth | 252/492 |
| 703,064 | 6/1902 | Hicks . | |
| 928,580 | 7/1909 | Buhlmann | 431/100 |
| 1,436,296 | 11/1922 | Soper et al. | 431/100 |
| 2,546,115 | 3/1951 | Ulmer | 427/159 |

FOREIGN PATENT DOCUMENTS

| | | | |
|---|---|---|---|
| 9551 | of 1902 | United Kingdom | 427/159 |
| 255 | of 1906 | United Kingdom | 431/100 |

OTHER PUBLICATIONS

"The Rare Earth Industry," Chapt. I, pp. 15–28, Martin, Editor (Crosby, Lockwood & Son, London, 1918).

*Primary Examiner*—Randall L. Green

[57] ABSTRACT

Incandescent mantles of improved strength and durability are provided for use with fuel-burning lanterns. The mantles are characterized by the use of a hydroxide mixture on the mantle sack of which the primary component is yttrium hydroxide together with a critical proportion of cerium hydroxide, whereby on conversion of the hydroxides to the corresponding oxides of the incandescent mantle, illumination is provided of a candle power comparable to that of the standard thorium oxide-cerium oxide mantles while at the same time obtaining a mantle of greatly increased strength and durability, as needed especially for use with fuel-burning lanterns where the mantles are subjected to frequent mechanical shocks.

9 Claims, No Drawings

YTTRIUM OXIDE MANTLES FOR FUEL-BURNING LANTERNS

BACKGROUND AND PRIOR ART

The field of this invention relates to incandescent mantles as employed with fuel-burning devices to produce illumination, such as portable fuel-burning lanterns.

During the Gaslight Era, extending from the latter part of the 19th century into the early part of the 20th century, incandescent gas mantles were products of major commercial importance. During that period, there was intensive research and development to provide mantles of better illuminating power with respect to the amount of gas being burned, and also to provide mantles which were adequately strong and durable in use. The history of the manufacture of incandescent gas mantles is described in *The Rare Earth Industry,* Martin editor (Crosby, Lockwood & Son, London, 1918), Chapt. I, pages 15–28.

The first mantles were made of oxides of zirconium, lanthanum, and yttrium. These mantles had poor strength and durability and inadequate lighting power. Thorium oxide mantles were an improvement, but did not become commercially successful until around 1893 when Welsbach developed and patented a thorium oxide mantle containing around 1% cerium oxide. The cerium oxide promoted the light emission of the thorium oxide with a radiation peak around 0.92% cerium oxide. (See FIG. 5, page 16, *The Rare Earth Industry,* cited above.) Welsbach's U.S. Pat. No. 563,524 of 1896 covering his thorium oxide-cerium oxide mantle. The Welsbach mantle as used commercially also contained a small percent of magnesium oxide.

Although many attempts were made to develop a better mantle, the Welsbach mantle became the standard mantle for gaslight illumination. The preference for the Welsbach mantle has continued to the present day with respect to its use in portable incandescent lanterns. One widely used commercial formula for lantern mantles is 99.1% $ThO_2$, 0.6% $CeO_2$, and 0.3% MgO. In its application to portable lanterns, however, this version of the Welsbach mantle has provided problems in both manufacturing and use.

The $Th^{232}$ isotope which comprises the principal isotope component of thorium is the parent of the thorium decay series. It causes the $ThO_2$ to be mildly radioactive. Although the amount of radioactivity in the finished Welsbach mantles is harmless and miniscule, special handling precautions are necessary to protect manufacturing personnel when large quantities are used. These procedures are complex and make processing difficult and costly.

Although the illuminating power of the Welsbach mantle is high, its strength and durability are not entirely satisfactory. These weaknesses are especially notable in portable lanterns. Portable lanterns are subject to shocks in handling, which jar the mantles after they have been fired and are in a relatively fragile condition. For lacquered mantles as manufactured in the United States, the attachment or head portions of the mantle sacks have been hardened by applying a solution of aluminum nitrate and other metal salts. This protects the mantle heads but cannot be used for the mantle bodies because the hardening metals are not luminescent. In use the mantles tend to rupture below the attachment heads. Greater tensile strength and greater durability has been needed.

In the commercial manufacture of Welsbach type mantles for lanterns, tests have been developed for the purpose of attempting to standardize tensile strength and/or durability properties. In one of these tests, referred to as the "Bump Test", test specimens of a production run of the mantle sacks after firing and cooling are subjected to repeated bumping shocks. It has been found that the average durability of the fired mantles on the basis of the Bump Test is lower than desirable, and that the Bump Test survival counts vary considerably despite standardized manufacturing. Mantles from some production runs break after as little as 50 to 100 bumps, while others last for as long as 600 to 800 bumps. The cause of this variability is not known. Prior to the present invention no means has been known for improving the tensile strength and durability of the mantles, or for providing improved consistency of durability in manufacturing.

As will subsequently be described in greater detail, the improved mantle of the present invention contains yttrium oxide as a major ingredient. Mantles composed primarily of yttrium oxide are not known to have been previously used commercially although some of the early commercial mantles are understood to have contained minor amounts of yttrium oxide. The patent art in the period from 1890 to 1910 includes patents referring to the use of yttrium oxide in mantles in admixtures with other oxides. The following references are believed to be representative:

Hicks Pat. No. 703,064 of 1902;
Welsbach Pat. No. 399,174 of 1889; and
Welsbach Pat. No. 359,524 of 1887.

SUMMARY OF INVENTION

The present invention is based in part on the discovery that incandescent mantles of improved strength and durability can be manufactured by employing yttrium oxide as the primary metal oxide instead of thorium oxide as used in the Welsbach mantles. It has been further discovered that by employing a critical ratio of cerium oxide to the yttrium oxide high illuminating power can be obtained, which for practical purposes is comparable to the illumination provided by Welsbach type mantles. The improved mantles are particularly useful in portable lanterns such as outdoor camping-type lanterns using liquid or gaseous fuels.

In the preferred embodiments of the present invention, the amount of cerium oxide employed is within the range from 1.8 to 3.8 parts by weight per 100 parts of yttrium oxide. Optimization of candle power appears to be obtained, based on presently available data, at about 2.9 to 3.5 parts of cerium oxide per 100 parts of yttrium oxide. The yttrium oxide mantles also preferably contain a small percent of a crystal growth inhibiting metal oxide such as magnesium oxide or aluminum oxide. For example, from 0.5 to 1.5% by weight of the inhibiting oxide can be employed per 100 parts of the yttrium oxide.

In a related discovery, it has been found that manganese acetate is a preferred hardening agent for application to the yttrium oxide mantle sack heads. The manganese acetate can be applied in an aqueous solution without dissolving the applied yttrium and other metals, which at this stage in the process are in the form of hydroxides. The prior art hardening agent aluminum nitrate was found to result in weakening of the heads which therefore defeated the purpose of its use with the yttrium mantles.

Other preferred features and advantages of the present invention will be described in the subsequent detailed description.

DETAILED DESCRIPTION

The yttrium mantles of this invention can be prepared by the same manufacturing procedures and with the same manufacturing equipment as has been previously employed for manufacturing Welsbach-type mantles for portable lanterns. However, an important advantage is that no radioactive substances are involved, as is the case with thorium mantles. This results in a substantial savings in manufacturing costs.

As with the Welsbach mantles, a woven cloth of combustible filaments, such as rayon or cotton, is impregnated with an aqueous solution of the metal nitrates. The applied nitrates are converted to the corresponding hydroxides with ammonia gas or aqueous ammonium hydroxide. After drying, the impregnated cloth may be coated with a lacquer. The lacquered cloth is dried, cut into small pieces, and sewn into mantle sacks having an open top and rounded bottoms. The use of a lacquer coating is optional, although desirable to facilitate rapid mechanical processing. However, where used it tends to reduce the strength and durability of the mantles, especially the head portions which are attached to the lantern burners.

To increase their strength the head portions may be impregnated with a hardening solution of non-incandescing metals. Prior art hardening solutions used aluminum nitrate as a principal ingredient, but this has been found undesirable with respect to the yttrium mantles of the present invention. The preferred hardening solution for the present invention will be described below.

For attachment of the mantle heads to lantern burners, a non-combustible filament is laced around the head portions so that it may be employed to draw and tie the head portions. The thread used to sew the mantle sacks is a combustible thread which has been treated in the same manner as the mantle sacks, that is, being impregnated with the metal nitrates which have been converted to their corresponding hydroxides. Rayon cloth and rayon thread are commonly employed.

After the mantles have been attached to the lanterns and are ready for use, they are fired by lighting the rayon. The firing is completed by igniting fuel supplied to the burners, which may be either vaporized liquid fuel, such as gasoline or kerosene, or gaseous fuel, such as propane or butane. The firing of the mantles converts the metal hydroxides to their corresponding oxides. In the form in which the mantles are used to provide incandescent illumination, they therefore comprise a mixture of yttrium oxide and cerium oxide in critical proportions together with a small amount of crystal grain growth inhibiting metal oxide such as magnesium oxide or aluminum oxide. The relative proportions of the metals to be employed are summarized below with respect to the solution proportions of the metal nitrates, the mantle proportions of the metal hydroxides before firing, and the mantle proportions of the metal oxides after firing.

| Ingredients | General Formula Parts by Weight | Preferred Formula Parts by Weight |
|---|---|---|
| | Solution Proportions | |
| $y(NO_3)_3$ | 100 | 100 |
| $Ce(NO_3)_4$ | 1.34 to 2.8 | 2.2 to 2.6 |
| $Mg(NO_3)_2$ or | .19 to 3.8 | 0.94 to 2.8 |
| $Al(NO_3)_2$ | .22 to 4.3 | 1.1 to 3.2 |
| | Mantle Proportions Before Firing | |
| $y(OH)_3$ | 100 | 100 |
| $Ce(OH)_3$ | 1.6 to 3.4 | 2.6 to 3.1 |
| $Mg(OH)_2$ or | .11 to 2.3 | 0.56 to 1.8 |
| $Al(OH)_3$ | .12 to 2.5 | 0.61 to 1.9 |
| | Mantle Proportions After Firing | |
| $y_2O_3$ | 100 | 100 |
| $CeO_2$ | 1.8 to 3.8 | 2.9 to 3.5 |
| MgO or | 0.1 to 2.0 | 0.5 to 1.5 |
| $Al_2O_3$ | 0.1 to 2.0 | 0.5 to 1.5 |

In the foregoing tabulations of relative proportions, the amounts of the other metal compounds are on the weight basis of 100 parts of the yttrium compounds. For example, the mantles after firing should contain from 1.8 to 3.8 parts by weight of cerium oxide per each 100 parts of yttrium oxide. It is also desirable to include from 0.1 to 2.0 parts of the crystal grain growth inhibiting metal oxide, such as magnesium oxide or aluminum oxide. Berylium oxide will also serve this purpose, but is less desirable for commercial use. In the preferred formulation, from 2.9 to 3.5 parts by weight of cerium oxide will be employed per 100 parts of yttrium oxide together with from 0.5 to 1.5 parts of magnesium oxide or aluminum oxide per 100 parts of yttrium oxide. The corresponding proportions of the hydroxides and nitrate of the metals are set out in the tabulation. Other corresponding values can easily be calculated.

For rapid impregnation of the mantle cloth in a single soaking and drying sequence, it has been found desirable to employ a warm relatively concentrated aqueous solution.

After soaking in the impregnating solution, the mesh tubes while still wet are suspended in a reactor where they are contacted with ammonia vapor. On completion of the reaction which converts the metal nitrate hydrates to metal hydroxides, the mantle cloth is washed and dried.

The treated cloth is then coated with a mantle lacquer. An organic solvent solution of a nitrocellulose-type lacquer may be used. The lacquer is applied by dipping the treated rayon in a lacquer bath on the cloth. The cloth is then dried to remove the lacquer solvent.

The lacquered cloth is then cut and sewn to form the mantle sacks. Rayon thread impregnated with the same mixture of metal compounds as the cloth is preferably used for the sewing. The thread has been reacted in the same manner so that the metals are present in the form of their hydroxides. The mantle sacks typically have a circumference of about $4\frac{1}{2}$ inches and a length of about $2\frac{3}{4}$ inches. They are sewn to provide an open top with closed sides and rounded bottom.

After the mantle sacks have been cut, sewn, and turned inside out their upper head portions are stamped on both sides with a hardening solution. For the purpose of the present invention, it is desirable to employ manganese acetate as the preferred metal salt. For example, the aqueous hardening solution should contain from about 5 to 20% by weight manganese acetate. Other metal salts may also be present as may small amounts of water-miscible organic solvents, such as ethanol or methanol. The pH of the hardening solution is preferably around neutrality, such as in the range from 6.0 to 8.0. This permits the metal compounds to be added to the head without excessive dissolving of the yttrium hydroxide or other hydroxides previously applied. The purpose of using some organic solvent in the water is to partially dissolve the lacquer coating on the mantle heads, thereby facilitating penetration and impregnation by the hardening solution. After application of the hardening solution, the mantle sacks are dried.

In a final step, a non-combustible material is threaded through and around the mantle heads, the ends of the thread like material being left free for use in tying the mantles to the support collars provided on the ends of the burners in the lanterns. After being attached to the lantern, the mantle sacks are fired, which eliminates the combustible rayon threads, leaving replicas of the threads and cloth in the form of the refractory metal oxides, which luminesce to produce the desired illumination.

The present invention is illustrated in preferred embodiment by the following example.

EXAMPLE I

Commercially available yttrium nitrate, cerium nitrate, and magnesium nitrate hydrates are mixed in the following weight proportions. 95.62% $Y(NO_3)_3.6H_2O$; 2.43% $Ce(NO_3)_4.6H_2O$ and 1.95% $Mg(NO_3)_2.6H_2O$. The nitrate mixture is dissolved in distilled or ion-free water, using 180 parts of the mixture per 100 parts by weight of water. The solution is warmed and held for use as an impregnating solution. No special precautions need be taken as required for handling radioactive substances.

Knitted tubes of rayon mesh are soaked in the impregnating solution. The mesh tubes are removed from the impregnating solution, drained, and dried. The dried impregnated tubes are reacted with ammonia gas. The reaction converts the metal nitrate hydrates to their corresponding hydroxides, that is, to yttrium hydroxide, cesium hydroxide, and magnesium hydroxide. The resulting proportions of the hydroxides will be 95.86% $Y(OH)_3$, 2.93% $Ce(OH)_4$, and 1.21% $Mg(OH)_2$. This mixture on firing will convert to metal oxides of the following weight percentages: 95.7% $Y_2O_3$, 3.27% $CeO_2$, and 1.03% MgO.

The treated cloth tubes are washed to remove the ammonium nitrate formed in the reaction. The washed tubes are dried, and then coated with a nitrocellulose-type mantle lacquer. After drying to remove the lacquer solvent, the flat cloth tubing is cut to length and sewed simultaneously. The cut and sewn tube sections have an approximate size of 2¼ by 3 15/16 inches. The pieces are turned inside out and are in the shape of mantle sacks. Tops open to form mantles of a circumference of about 4½ inches and a length of about 3 7/16 inches.

A mantle head hardening solution is prepared according to the following formula:

| Ingredients | Wt. % |
|---|---|
| Manganese Acetate | 7 |
| Water | 81 |
| Ethanol | 12 |

-continued

| Ingredients | Wt. % |
|---|---|
| Dye | Trace |

The foregoing hardening solution has a pH of approximately 6.5. The hardening solution is applied to the upper portions of the mantles, comprising a band of about 1¼ inches width, by stamping the solution from solution-impregnated pads on both sides of the mantle sack head portions. The mantle sacks are then dried to remove the solvent from the head portions.

Pieces of non-combustible filaments of a length of about 7 inches, are then threaded through and around the head portions, leaving the free ends of the strings extending outwardly. This completes the manufacturing of the mantles, except for packaging. The size of the finished mantle sack is 4½ inches circumference by 2¾ inches long.

In use, the mantles are attached to the burners of the lanterns so that the vaporized or gaseous fuel and air mixture burns within and on the mantles. On first firing, the mantles are converted to the oxide mixture described above which produces a high degree of illumination comparable to that produced by the Welsbach-type mantles. In durometer measurements of tensile strength, the fired mantles after one hour of operation have been found to have tensile strength up to four times the tensile strength of Welsbach mantles. Tensile strength declines with continued burning, but the yttrium oxide mantles retain their tensile strength better than the Welsbach mantles. The durability of the yttrium mantles as determined by the standard Bump Test has been found to be consistently higher than that of the Welsbach-type mantles, the mantles of this invention surviving for 1,000 or more bumps, and consistently providing such higher level of durability. The bump test durability declines with continued burning, but the yttrium mantles continue to provide much better durability than the Welsbach mantles. For example, after 100 hours of use in comparative tests the yttrium mantles survived at least 60 bumps on the average while the present commercial Welsbach mantles failed on the average to survive more than 13 bumps.

I claim:

1. A mantle of improved strength and durability for a fuel-burning lantern, comprising an open-topped woven combustible mantle sack impregnated with a mixture of metal hydroxides convertible to the corresponding metal oxides on first firing to provide an incandescent metal oxide mantle, the upper portion of said mantle sack providing a hardened attachment head, wherein the improvement comprises having said mantle sack impregnated with a hydroxide mixture consisting essentially of yttrium hydroxide modified with a small proportion of cerium hydroxide, said hydroxides being present in relative proportions providing a metal oxide mantle containing from 1.8 to 3.8 parts by weight of cerium oxide per 100 parts of yttrium oxide.

2. The mantle of claim 1 in which said hydroxide mixture also contains a crystal growth inhibiting metal hydroxide selected from the group consisting of magnesium hydroxide and aluminum hydroxide, said inhibiting hydroxide being present in a relative proportion providing from 0.1 to 2.0 parts by weight of the corresponding oxide per 100 parts yttrium oxide.

3. The mantle of claim 1 in which said cerium hydroxide is present in a relative proportion providing from 2.9 to 3.5 parts by weight of cerium oxide per 100 parts of yttrium oxide.

4. The mantle of claim 1 in which said combustible filaments are rayon.

5. The mantle of claim 1 in which said metal hydroxide mixture has been formed by soaking the mantle sack in an aqueous solution of the corresponding metal nitrates and then converting the applied nitrates to the hydroxides by reaction with ammonia, said soaking solution having a specific gravity of from 1.40 to 1.63 and a temperature in the range from 85° to 120° F.

6. The mantle of claim 1 in which said attachment head has been coated with manganese acetate to add strength to said head.

7. A mantle of improved strength and durability adapted for use with portable fuel-burning lanterns, comprising an open-topped woven rayon mantle sack impregnated with a mixture of metal hydroxides convertible to the corresponding metal oxides on first firing to provide an incandescent metal oxide mantle, the upper portion of said mantle sack providing a hardened attachment head, wherein the improvement comprises having said mantle sack impregnated with a hydroxide mixture consisting essentially of yttrium hydroxide modified with small proportions of cerium hydroxide and magnesium hydroxide, said hydroxides being present in relative proportions providing a metal oxide mantle containing from 1.8 to 3 parts by weight of cerium oxide and from 0.5 to 1.5 parts by weight of magnesium oxide per 100 parts of yttrium oxide, said attachment head having been coated with manganese acetate to add strength to said head.

8. The mantle of claim 7 in which said cerium hydroxide is present in a relative proportion providing from 2.9 to 3.5 parts by weight of cerium oxide per 100 parts of yttrium oxide.

9. A mantle of improved strength and durability for a portable fuel-burning lantern, including a rayon mesh mantle sack impregnated with a mixture of metal hydroxides convertible to the corresponding metal oxides on first firing to provide an incandescent metal oxide mantle, wherein the improvement comprises employing a hydroxide mixture consisting essentially of yttrium hydroxide, cerium hydroxide, and manganese hydroxide, said hydroxides being present in relative proportions providing a metal oxide mantle containing from 2.9 to 3.5 parts of cerium oxide and from 0.5 to 1.5 parts of magnesium oxide per 100 parts of yttrium oxide, said mantle sack including a head portion to which a coating containing manganese acetate has been applied to add strength to said head without dissolving the yttrium hydroxide thereon.

* * * * *

UNITED STATES PATENT AND TRADEMARK OFFICE

CERTIFICATE OF CORRECTION

PATENT NO. : 4,533,317

DATED : August 6, 1985

INVENTOR(S) : Gilbert J. Addison

It is certified that error appears in the above-identified patent and that said Letters Patent is hereby corrected as shown below:

Column 5, line 44, cancel "cesium" and substitute --cerium--.

Signed and Sealed this

Twenty-seventh Day of August, 1991

*Attest:*

*Attesting Officer*

HARRY F. MANBECK, JR.

*Commissioner of Patents and Trademarks*